US011498299B2

(12) United States Patent
Baumgartner et al.

(10) Patent No.: US 11,498,299 B2
(45) Date of Patent: Nov. 15, 2022

(54) RADIAL PRESS

(71) Applicant: UNIFLEX HYDRAULIK GmbH, Karben (DE)

(72) Inventors: Carsten Baumgartner, Laubach (DE); Reiner Viehl, Frankfurt (DE)

(73) Assignee: UNIFLEX-HYDRAULIK GMBH, Karben (DE)

( * ) Notice: Subject to any disclaimer, the term of this patent is extended or adjusted under 35 U.S.C. 154(b) by 337 days.

(21) Appl. No.: 16/655,996

(22) Filed: Oct. 17, 2019

(65) Prior Publication Data

US 2020/0047440 A1 Feb. 13, 2020

Related U.S. Application Data

(63) Continuation of application No. PCT/EP2018/059246, filed on Apr. 11, 2018.

(30) Foreign Application Priority Data

Apr. 20, 2017 (DE) ..... 10 2017 108 399.5

(51) Int. Cl.
*B30B 7/04* (2006.01)
*B21D 37/14* (2006.01)
*B21D 39/04* (2006.01)

(52) U.S. Cl.
CPC ..... *B30B 7/04* (2013.01); *B21D 37/145* (2013.01); *B21D 39/048* (2013.01)

(58) Field of Classification Search
CPC ..... B30B 7/04; B21D 37/145; B21D 39/048; B21D 39/046; B23P 11/005; B25B 27/10
(Continued)

(56) References Cited

U.S. PATENT DOCUMENTS 5,243,846 A * 9/1993 Davis ..... B21D 39/048 72/402
6,257,042 B1 7/2001 Välimäki et al.
7,553,268 B2 * 6/2009 Ziliani ..... B21J 7/14 483/29

FOREIGN PATENT DOCUMENTS

DE 2844475 A1 4/1980
DE 3331721 A1 3/1985
(Continued)

OTHER PUBLICATIONS

Notification of Transmittal of International Preliminary Report on Patentability with Preliminary Report and written spinion issued by the International Searching Authority, dated Oct. 31, 2019; full English translation attached.
(Continued)

*Primary Examiner* — Shelley M Self
*Assistant Examiner* — Smith Oberto Bapthelus
(74) *Attorney, Agent, or Firm* — Myers Wolin, LLC

(57) ABSTRACT

A radial press has a plurality of press bodies arranged around a press axis which can be moved radially in relation to the press axis, and a drive unit for shifting the press bodies in the direction of or away from the press axis. The press bodies each have a main jaw and a pressing jaw, which is fixed interchangeably on the main jaw. The main jaws each comprise a radially inwardly arranged pressing-jaw-supporting surface and, adjacent to the latter in the circumferential direction, two side surfaces. The pressing jaws butt against the pressing-jaw-supporting surface of the associated main jaw and have a fixing protrusion, which projects from the abutment surface, enters into a mount provided on the main jaw and interacts with a locking device. Each main jaw has a recess on its supporting surface which extends from the mount and opens out on one of the side surfaces.

12 Claims, 5 Drawing Sheets

(58) Field of Classification Search
USPC ..... 72/402
See application file for complete search history.

(56) References Cited

FOREIGN PATENT DOCUMENTS

| | | | |
|---|---|---|---|
| DE | 3611253 | A1 | 10/1987 |
| DE | 4135465 | A1 | 4/1993 |
| DE | 19912976 | A1 | 9/2000 |
| DE | 20109212 | U1 | 10/2002 |
| DE | 10047025 | C2 | 11/2002 |
| DE | 10149924 | A1 | 4/2003 |
| DE | 19817882 | B4 | 8/2005 |
| DE | 102015004440 | B3 | 3/2016 |
| DE | 202016100660 | U1 | 3/2016 |
| DE | 102015002556 | B3 | 5/2016 |
| DE | 202016008097 | U1 | 3/2017 |
| EP | 1252943 | A1 | 10/2002 |
| EP | 1610915 | B1 | 1/2006 |
| EP | 2420332 | A1 | 2/2012 |
| SU | 761107 | A1 | 9/1980 |
| WO | 2004 087349 | A1 | 10/2004 |
| WO | 2018 192814 | A1 | 10/2018 |

OTHER PUBLICATIONS

International Search Report issued by the International Searching Authority for corresponding International Patent Application No. PCT/EP2018/059246, dated Aug. 7, 2018, with English translation attached.

* cited by examiner

RADIAL PRESS

CROSS REFERENCE TO RELATED APPLICATIONS

This application is a continuation under 35 U.S.C. § 120 of International Application PCT/EP2018/059246, filed Apr. 11, 2018, which claims priority to German Application No. 10 2017 108 399.5, filed Apr. 20, 2017, the contents of each of which are incorporated by reference herein.

FIELD OF THE INVENTION

The present invention relates to a radial press, comprising a multiplicity of press members disposed around a press axis and capable of moving radially relative to the press axis, and a drive unit for moving the press members in the direction of the press axis or away from it, wherein the press members are made in multiple parts and respectively have a base jaw and a press jaw fixed exchangeably on it, the base jaws respectively comprise a radially inwardly disposed press-jaw bracing face as well as, adjacent hereto in circumferential direction, two side faces, and the press jaws bear respectively with a mating face on the press-jaw bracing face of the associated base jaw and have, protruding from the mating face, a fixation projection, which is inserted in a seat provided on the base jaw and cooperates with a locking device disposed there. Furthermore, the present invention relates to a radial-press system, which comprises a radial press, a press-jaw magazine for storing replacement press jaws in sets and a quick-change jig functioning for changing of press jaws all together.

BACKGROUND

In order to be able to machine differently dimensioned workpieces with radial presses, they can typically be retrofitted by equipping them with variously dimensioned press jaws in such a way that pressed shapes having different diameters may be performed with them. These (exchangeable) press jaws are fixed radially inwardly on the base jaws, which in turn can be moved by the drive unit radially relative to the press axis. The said fixation projections, which are provided on the press jaws for exchangeable attachment of the press jaws to the base jaws, and which protrude from the mating faces of the press jaws, are inserted in seats provided on the base jaws and cooperate with locking devices of the base jaws, are realized, for example, as pins, pegs or bolts protruding radially outwardly from the press jaws. This is the case regardless of the actual specific design of the radial press; in particular, radial presses based on the so-called hollow-piston design (see, for example, DE 10149924 A1, EP 2420332 A1, EP 1610915 B1) can be regularly constructed in retrofittable manner according to the described principle, as can radial presses according to the so-called yoke design (see, for example, DE 4135465 A1, DE 19912976 A1, DE 19817882 B4, EP 1252943 A1, DE 202016008097 U1, DE 202016100660 U1) and also radial presses in other designs, for example the so-called pressure-plate design (see, for example, DE 2844475 A1, DE 3611253 A1, DE 10047025 C2, DE 3331721 A1).

A widespread practice is placement of the press jaws on the base jaws by radial movement of the respective press jaws relative to the base jaw in question. In the process, the press jaws may be placed individually by hand (from radially inside) onto the base jaws. In contrast, during simultaneous exchange of all press jaws of the respective set (see hereinafter), the (simultaneous) radial movement of all base jaws and press jaws relative to one another is brought about by movement—corresponding to closing of the radial press—of the base jaws by means of the drive unit radially inward until the latching units snap into place. Demounting of the press jaws (individually or else in sets) takes place in the inverse direction, wherein the locking devices are unlocked appropriately for this purpose.

According to an alternative concept, the press jaws are mounted by being pushed axially onto the base jaws. For this purpose, the seats on the base-jaw sides for the fixation projections of the press jaws on the press-jaw bracing faces of the base jaws respectively extend in axial direction in slot-like manner up to each base-jaw front side, from which the mounting of the press jaws takes place.

As was already mentioned in the foregoing, the press-jaw set—typically comprising eight press jaws—may be handled as a whole for exchange of the press jaws, so that the complete press-jaw set stored in a corresponding magazine is inserted into the radial press or removed from this and stored in the magazine. This reduces not only the time needed in association with retrofitting of a radial press but also the risk of (improper) equipping of the radial press with press jaws of different types. For the said handling of all press jaws of a press-jaw set all together, a quick-change tool having a handle and a press-jaw holder is used, which holds the press jaws in a manner disposed uniformly concentrically around the tool axis.

Various quick-change jigs are known for the corresponding changing of all press jaws all together under radial movement of press jaws and base jaws (see hereinabove) relative to one another, i.e. for movement of the base jaws all together in the sense of closing of the radial press. In the simplest case, the quick-change jig together with the press-jaw set received on it can be freely positioned therein by the operator of the radial press (see, for example, U.S. Pat. No. 6,257,042 B1 and DE 20109212 U1). However, it is more comfortable for the operator when a kind of positioning aid is provided (see, for example, DE 202015002566 U1). It is particularly comfortable when, via centering elements corresponding to one another on the quick-change jig and mating pieces on the radial press, it is provided, for centering of the quick-change jig in the radial press, that the tool axis is aligned with the press axis and in addition the press jaws are positioned such that the joining means, corresponding to one another, of the press jaws and base jaws (i.e. the fixation projections and seats) are aligned with one another. Such is known, for example, from EP 1610915 B1 and EP 2420332 A1. The centering means disclosed here also act in the sense of reduced danger of damaging the pins, pegs, bolts or other fixation projections mentioned in the foregoing during mounting of the press jaws.

The present invention has an object of providing a radial press that is improved compared with the prior art, especially in terms of flexibility, namely in terms of the possible pairings of base and press jaws.

SUMMARY

This stated object is achieved according to the presently described invention in that the base jaws are respectively provided at their press-jaw bracing face with a channel-like recess, which extends from the seat (for the fixation projection of the respective press jaw) to one of the side faces of the base jaw and is open at it. Such channel-like recesses, which extend respectively from one side face of the base jaw in question to its seat ensure that the fixation projections of the press jaws project at least in the end regions or partly into the contour—defined by the respective press-jaw bracing face—of the respectively associated base jaw as early as during mounting—which takes place by a turning movement of the press jaws around the press axis—of the press jaws. During mounting of the press jaws, their fixation projections travel—by the said turning movement of all press jaws of the set all together around the tool axis—from the respective side face of the base jaw in question along the recess of the associated base jaw to the seat in question. The angle of rotation in question during the process is preferably approximately half of the pitch, i.e. for a radial press having eight press members, approximately between 20° and 25°, for example approximately 22.5°.

A particularly prominent advantage consists in that, for mounting of the press jaws, the respective distance between the press-jaw bracing faces and the mating faces of the associated press jaws may be smaller than that amount by which the fixation projections on the respective mating face protrude radially from the press jaws. During application of the invention, therefore, it is even possible, for a given radial press, to mount such press jaws (all together as a set) that, due to inadequate distance between the base jaws in a radial press open to the maximum, would at best be mountable individually in conventional radial presses. By application of the invention, it is even possible to achieve certain configurations, i.e. certain pairings of base jaws and press jaws, that in conventional radial presses are not even possible at all by manual mounting of the individual press jaws. Seen from another perspective, it can be deduced as an advantage of the invention that longer fixation projections than in the prior art may be used, thus permitting implementation of additional functionalities in the fixation projections (see hereinafter). Yet another advantageous effect of the invention consists in that, in comparison with the prior art, more precise matching of the fixation projections and associated seats to one another in terms of their dimensioning is possible, and so the axial offset of the press jaws relative to one another, observed in the prior art and caused by corresponding play between fixation projections and seats, may be greatly reduced. Compared with such radial presses in which the press jaws are mounted by being pushed axially onto the base jaws and the base jaws are provided for this purpose with receiving slots, which extend in longitudinal or axial direction, for the fixation projections of the press jaws, a quite decisive advantage of the invention consists in the much smaller weakening of the base jaws, specifically in that, in the inventive concept, the particularly stressed front-side end regions of the base jaws (namely in the particularly stressed middle plane), may be constructed in massive and intact manner.

The recesses characteristic for the inventive radial presses extend, according to a first preferred further development of the invention, exactly in circumferential direction. Thus recesses of the shortest possible length are achieved, thus resulting in only minimum weakening of the base jaws, and in addition are confined to the less heavily stressed middle region of the base jaws. In this case, mounting of the press jaws takes place by means of a strict two-stage movement (axial insertion at first, then turning in circumferential direction).

In typical constructional implementations of the present invention, the fixation projections of the press jaws are aligned, during axial insertion of the press-jaw set into the space bounded by the base jaws (while the radial press is opened), with the open spaces between respectively two base jaws adjacent to one another. In the case of more or less play-free guidance of the fixation projections into the open spaces in question through respectively the two base jaws bounding them, effective centering of the quick-change tool already takes place in such a way that its tool axis is aligned with the press axis.

The axial position of the quick-change tool together with the received press jaws, in which the second stage of mounting of the press jaws, i.e. the turning movement of the press jaws around the tool axis with displacement of the fixation projections into the recesses, is possible and is to be undertaken, may then be defined in particular by a stop (or several stops). In a particularly preferred configuration, such a depth stop (e.g. in the form of a disk) is provided on the quick-change jig and cooperate with the front sides of the base jaws. In this case, the disk in question may additionally act as protection against encroachment, which prevents anyone from reaching into the press-jaw installation space during the changing of press jaws and hereby contributes considerably to accident prevention.

In certain application situations, it may be advantageous when the base jaws are respectively provided, at that side face at which the respective recess opens, with a cutout extending from the opening of the recess to one of the front sides of the base jaw. Such peripheral cutouts, respectively provided in the region of the transition from the press-jaw bracing face to the side face in question of the base jaw, may function, so to speak, as "feeders" for the fixation screws at the openings of the recesses; they permit insertion of the press-jaw set together with fixation projections protruding into the contour defined by the press-jaw bracing faces even when the (other) open spaces between respectively two base jaws adjacent to one another are too narrow to receive the respective fixation projections. With appropriate dimensioning of the said cutouts, mounting or demounting of the press jaws is possible even when the radial press is completely or at least more or less closed, which may be advantageous for special applications using special press jaws.

Quite particularly preferably, such a cutout extending in axial direction to the front side of the base jaw (without connection to the recess) is also provided (in more or less mirror-image manner) on the opposite, second peripheral region of the press-jaw bracing face, i.e. in the transition region from the press-jaw bracing face to the second side face of the base jaw. In this case, the widening of the open space present between the base jaws and necessary for axial insertion of the press-jaw set in the press-jaw installation space for the fixation projections is distributed (more or less uniformly, depending on the constructional configuration in the individual case) over the two cutouts respectively disposed opposite one another. Thus optimum symmetry of the bracing of the press jaws on the base jaws can be achieved, and so, even in the case of extreme stress conditions, asymmetric deformation of the base jaws leading to tilting of the press jaws is ruled out. This favors fabrication precision, is protective toward material and thus acts in the sense of lengthening the useful life of the radial press.

Incidentally, the cutouts explained in the foregoing are able to take over the function of a depth stop described hereinabove, and so a separate stop is superfluous. This is so because, with suitable configuration, the inner ends of the cutouts (in cooperation with the associated centering projections) adjacent to the openings of the recesses effectively confine the axial insertion movement of the press-jaw set received on the quick-change tool exactly in a position in which the fixation projections are disposed opposite the openings of the recesses, and in this way the turning of the press-jaw set constituting the second stage of the insertion movement is possible.

In an alternative configuration, the cutout, explained in the foregoing, extending to one of the front sides of the base jaw in question, may even be provided not on that side face of the base jaw on which its recess opens but instead on the opposite side face. In this case, the recess of the adjacent base jaw respectively opens into the cutout or the cutout of a base jaw forms the "feeder", to the recess of the neighboring base jaw in question, for the fixation projection of the press jaw to be mounted on the adjacent base jaw.

The radial depth of the recesses provided may be based on the respective requirements. In the interests of a construction of the base jaws that is as stable as possible, the recesses are preferably not deeper than is necessary for achievement of the advantages aimed at in the individual case. In this sense, the recesses are generally less deep than the seats for the fixation projections. In this way the mounting of the press jaws is typically concluded with a radial movement (albeit shorter than that known from known machines) of the base jaws and press jaws relative to one another, whether it be by a radially inwardly directed movement of the base jaws in the sense of closing of the radial press or else a radially outwardly directed movement of the press jaws (for example using a quick-change jig corresponding to the concept according to DE 20109212 U1). In the individual case, however, the depth of the recesses may also correspond to the depth of the seats, and so mounting of the press jaws is possible even without radial movement of the base jaws and press jaws relative to one another (for example, when the radial press is completely closed; see hereinabove). In this case, the locking of the press jaws on the base jaws takes place near the end of the turning movement.

The orientation, explained in the foregoing, of the recesses in circumferential direction represents a configuration preferably realized in typical application situations; however, it is not absolutely necessary. Subject to specific prerequisites, other profiles of the recesses may also be advantageous in the individual case.

Thus, for example, extension of the recesses respectively along a helical line may also prove favorable instead of orientation of the recess in circumferential direction. Depending on the dimensions (especially the axial length of the base jaws), it is also conceivable to continue the recess beyond its opening at the side face of the base jaw and into the adjacent base jaw (if necessary, up to its front side). Incidentally, even in the case of such recesses not oriented in circumferential direction, the peripheral recesses described hereinabove may be provided in order to achieve the explained advantages associated with them.

According to yet another preferred further development, at least two fixation projections of geometrically different construction and/or at least two seats of geometrically different construction are provided. By such geometric individualization of at least one fixation projection or at least one seat, it is possible to ensure that the press-jaw set can be mounted in the base jaws of the radial press only in a single, predefined position. This further development is applicable, for example, during use of a press-jaw set in which one of the press jaws is provided with embossing types for marking the workpiece, since the corresponding marking press jaw should always be mounted on the lowermost base jaw. A preferred exemplary embodiment consists in that the fixation projection of one of the press jaws has such a thickening that this fixation device is located not in the usual open spaces between respectively two base jaws of the (opened) radial press but only in the one single open space widened by a cutout (see hereinabove).

Yet another preferred further development of the present invention is characterized in that the locking device (respectively installed in the base jaws) exerts a radially outwardly directed preload force on the fixation projection cooperating with it. In this way the locking device pulls the respective press jaw radially outward for secure, play-free bearing on the press-jaw bracing face of the associated base jaw. Thus the reproducibility of radial pressing and consequent the fabrication accuracy of the radial press can be improved.

In view of easy retrofitting of the radial press, i.e. of particularly simple changing of press jaws, it is advantageous when a bore, through which the locking device can be unlocked, is provided respectively at the front side of the base jaw. In a radial-press system that comprises a radial press, a press-jaw magazine containing replacement press jaws stored in sets for their attachment to the base jaws of the radial press, and a quick-change jig permitting changing of the press jaws all together and having a handle and a press-jaw holder, such bores can be used in such a way that the quick-change jig is further provided with an unlocking arrangement of unlocking elements capable of being inserted at the front side into the bores of the base jaws, wherein the press-jaw holder and the unlocking arrangement of the quick-change jig can be turned relative to one another around a tool axis. In this way it is possible by means of the quick-change jig—during implementation of the present invention—to turn the press jaws relative to the base jaws in order to mount or demount them, wherein the unlocking elements provided on the quick-change jig simultaneously unlock the locking devices. It is particularly advantageous in this case when the press-jaw holder of the quick-change jig is connected to its handle in a manner to be turned together therewith.

However, the unlocking elements functioning for unlocking of the locking devices may also be constructed in the most diverse but otherwise suitable ways. Besides mechanically acting unlocking elements such as pins, bolts or the like, contactlessly acting unlocking elements, for example, are—given corresponding construction of the locking devices—also conceivable, such as, for example, such on a magnetic basis. Even such unlocking elements are an expedient part of an unlocking arrangement, which can be turned—around the tool axis—relative to the press-jaw holder.

Merely to avoid mistaken impressions, it must be mentioned that the base jaws, for their part, do not necessarily have to be constructed in one piece. Instead, they may also be constructed in multiple pieces, in that they respectively comprise an intermediate jaw, placed on a base-jaw basis, on which the press-jaw bracing face is constructed. Likewise, it must be mentioned that the press-jaw bracing faces and the mating faces indeed are typically constructed according to a circular-cylinder portion, but again this is not absolutely necessary, since even different geometric configurations of the separating faces between base and press jaws may prove to be favorable in the individual case. Furthermore, it must be pointed out that, within the meaning of the present invention, the indication according to which the press members are radially guided in a manner movably displaceably relative to the press axis is not to be understood as limitative in the sense of a purely radial movement in a plane perpendicular to the press axis; to the contrary, the press members, as is customary in particular in certain radial-press designs according to the pressure-plate concept, also experience a certain axial displacement during pressing, so that the movement of the press members may have an axial component in addition to the radial component during their approach to the press axis as well as during their removal from it. Incidentally, not only mechanical, especially interlocking and/or latching interlocks are conceivable as the interlocking device for the press jaws; to the contrary, the "locking devices" may also ensure fixation of the press jaws on the respective associated base jaws in other ways, for example, by clamping action, by magnetic forces or the like.

BRIEF DESCRIPTION OF THE DRAWING

The present invention will be explained in more detail hereinafter on the basis of preferred exemplary embodiments illustrated in the drawing, wherein.

DETAILED DESCRIPTION OF THE PREFERRED EMBODIMENTS

Figure 1:
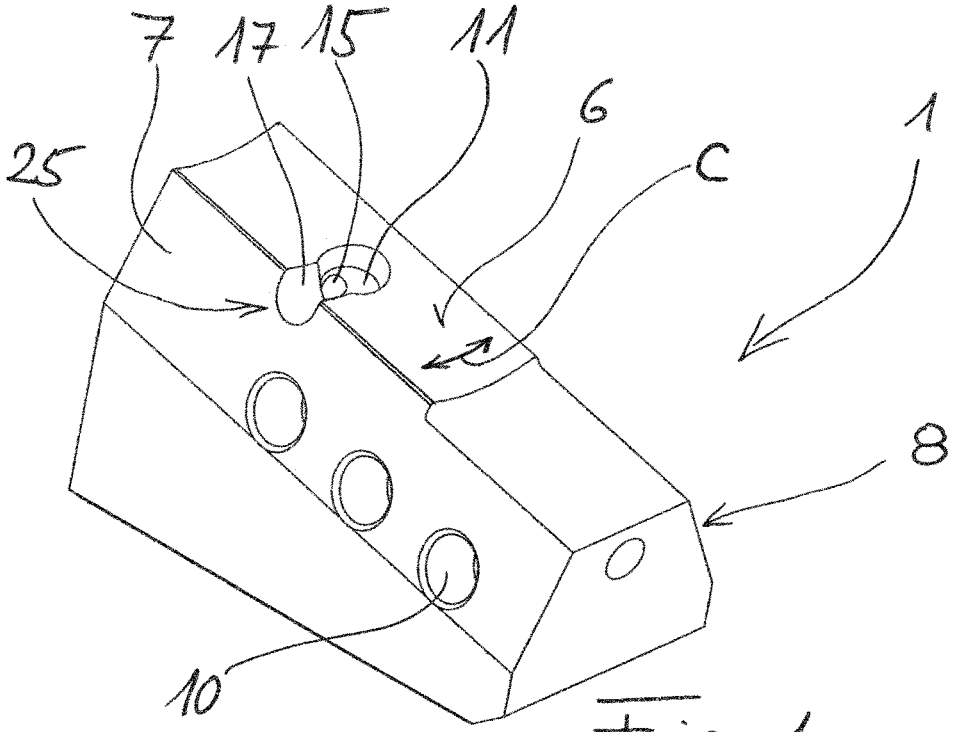
FIG. 1 shows a base jaw used in an inventive radial press according to a first exemplary embodiment, in a first perspective view.
Figure 2:
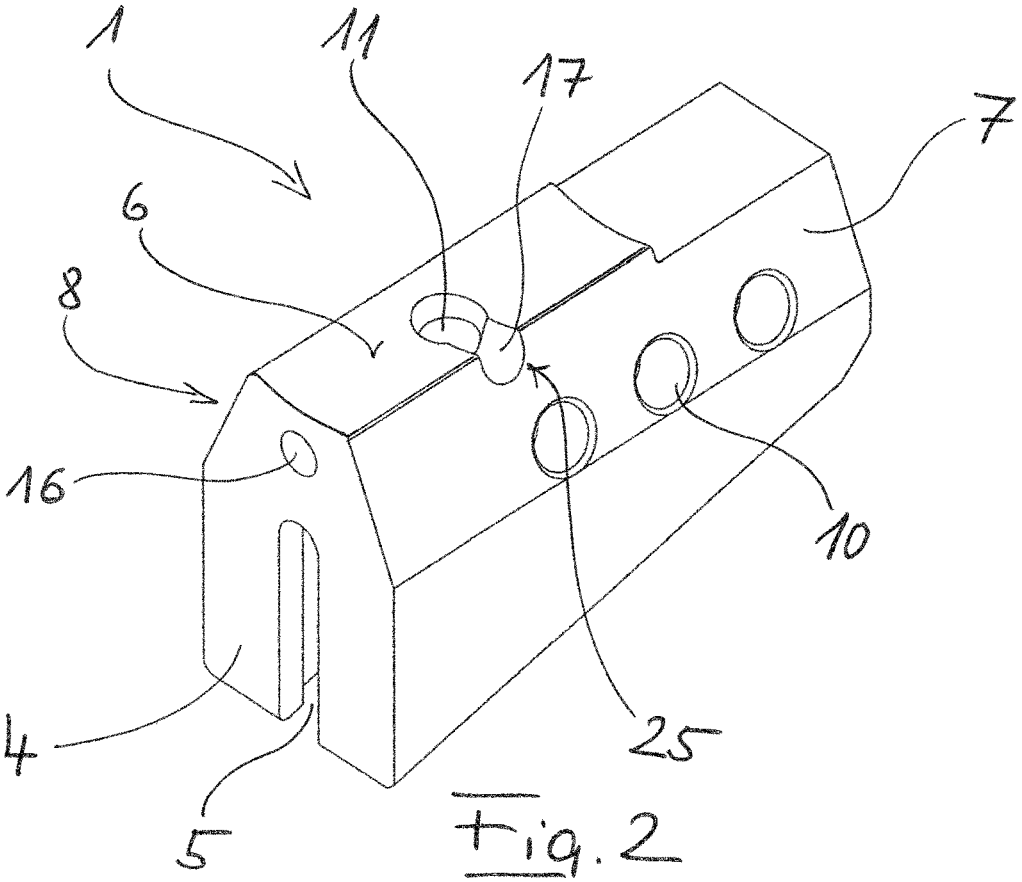
FIG. 2 shows the base jaw according to FIG. 1 from another perspective.
Figure 6:
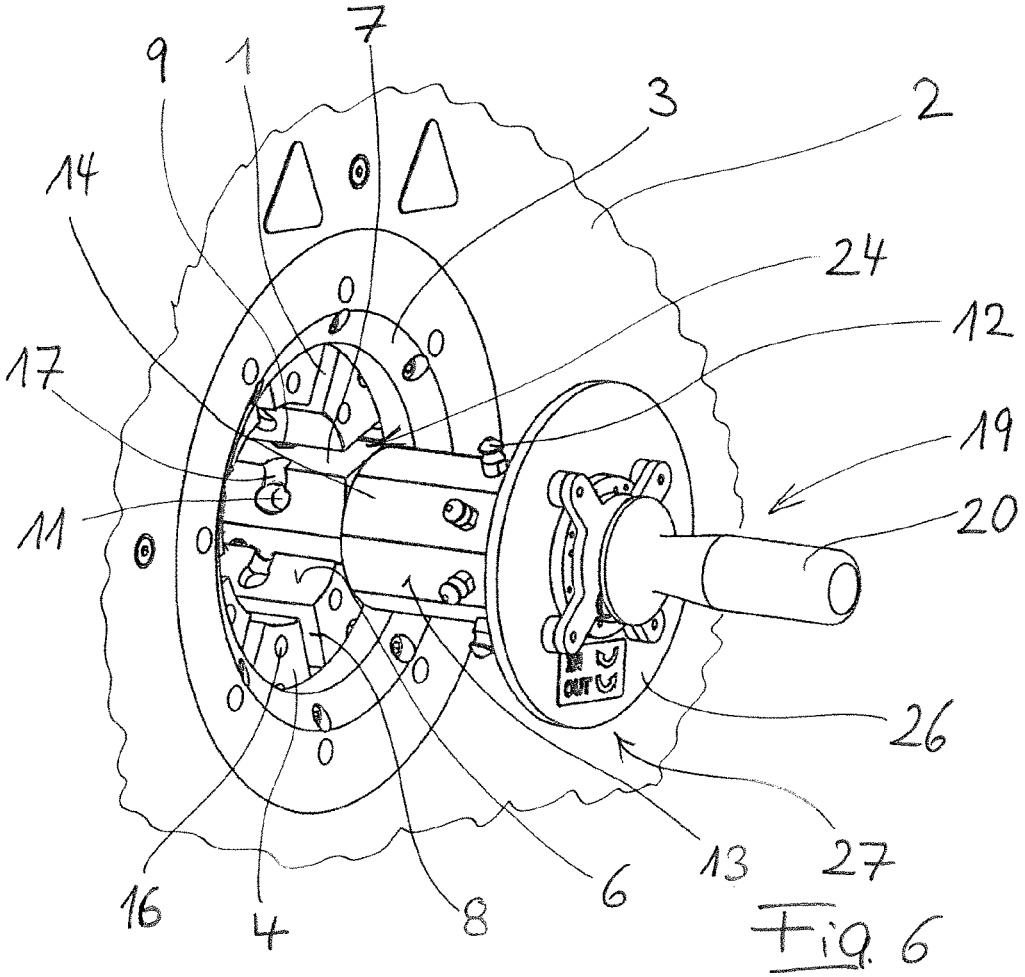
FIG. 6 shows one stage of changing of the press jaws on the radial press provided with the base jaws according to FIGS. 1 and 2.

The base jaw 1, illustrated in FIGS. 1 and 2, of the radial press 2 shown partly in FIG. 6 and provided with eight such base jaws has, to a rough approximation, a wedge-shaped configuration in a manner known as such. For its bracing, guided in radially displaceable manner on a frontal bracing disk 3 of the radial press 2, a guide slot 5 having a T-shaped cross section is provided on a first front side 4 of the base jaw 1, so as to cooperate with a guide block mounted on the bracing disk 3 and configured as a sliding block.

The base jaw 1 is provided radially inwardly with a press-jaw bracing face 6—constructed according to a circular-cylinder portion—and with a side face 7, 8 adjacent to this in circumferential direction and respectively adjoining the press-jaw bracing face on both sides. The said two side faces 7, 8 are oriented relative to one another with an angle of approximately 45°, and so the side faces 7, 8 disposed opposite one another on two base jaws 1 adjacent to one another are oriented at least substantially parallel to one another. On both sides, respectively three pockets 10 are provided that function to receive the ends of restoring springs 9, which respectively act between two base jaws 1 adjacent to one another in the sense of opening of the press tool. Furthermore, the base jaw 1 is provided radially inwardly with—disposed approximately centrally relative to the press-jaw bracing face 6—a seat 11 for a peg-like fixation projection 12, which protrudes radially outwardly—at the mating face 13 of the press jaw 14 designed for bearing on the press-jaw bracing face 6 of the associated base jaw 1 and likewise constructed approximately according to a circular-cylinder portion—from the press jaw 14 to be mounted on the base jaw 1.

The press jaw 14 placed respectively on the base jaw 1 is secured in position by cooperation, by means of interlocking latching, of a locking device 15 integrated in the base jaw 1 with the peg-like fixation projection 12 of the press jaw 14 engaging in seat 11. The locking device 15 is accessible through the bore 16 provided on the first front side 4 of the base jaw 1; it may be unlocked by means of a pin-shaped unlocking element introduced into it.

Within the scope described in the foregoing, the base jaw 1 corresponds to the sufficiently well known prior art, and so further explanations are not needed. Incidentally, this is similarly the case for the radial press 2 equipped with this base jaw 1, for example with respect to the basic design and the drive concept bringing about the radial movement of the base jaws 1; after all, this is not material to the present invention and even in this respect the radial press may correspond to the sufficiently well known prior art.

During implantation of the present invention, the base jaws 1 are respectively provided at their press-jaw bracing face 6 with a channel-like recess 17, which—oriented in circumferential direction C—extends from the seat 11 to a first side face 7 of the two side faces 7, 8 of the base jaw 1 and opens at this.

Figure 3:
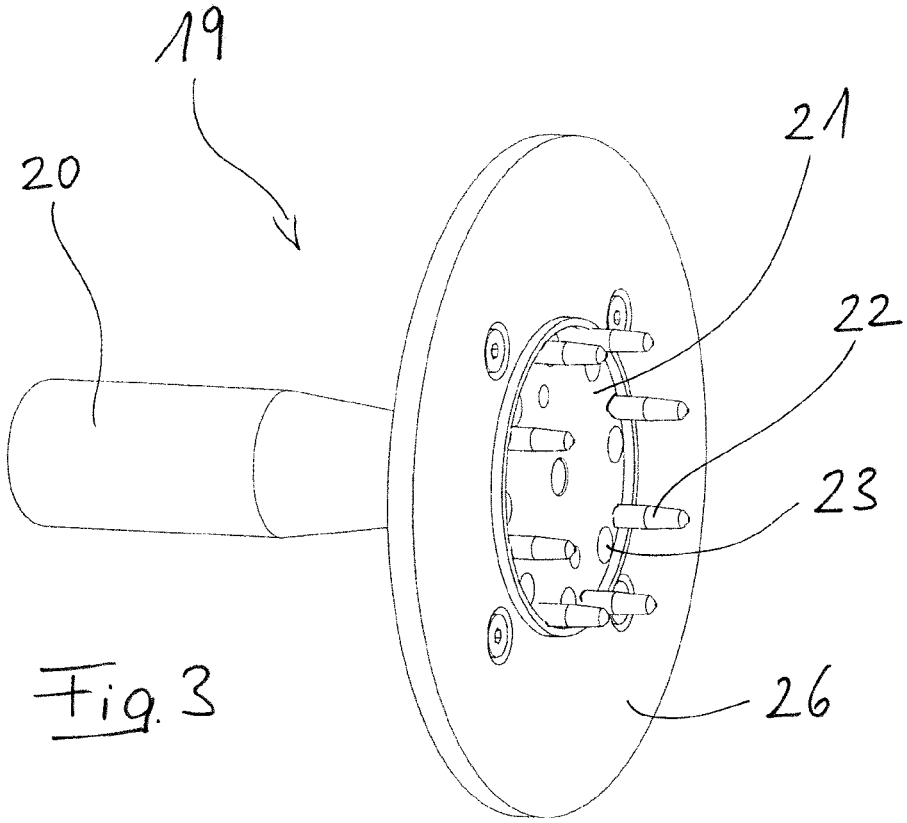
FIG. 3 shows a quick-change jig that can be used in connection with the present invention for changing of press jaws, from a first perspective.
Figure 4:
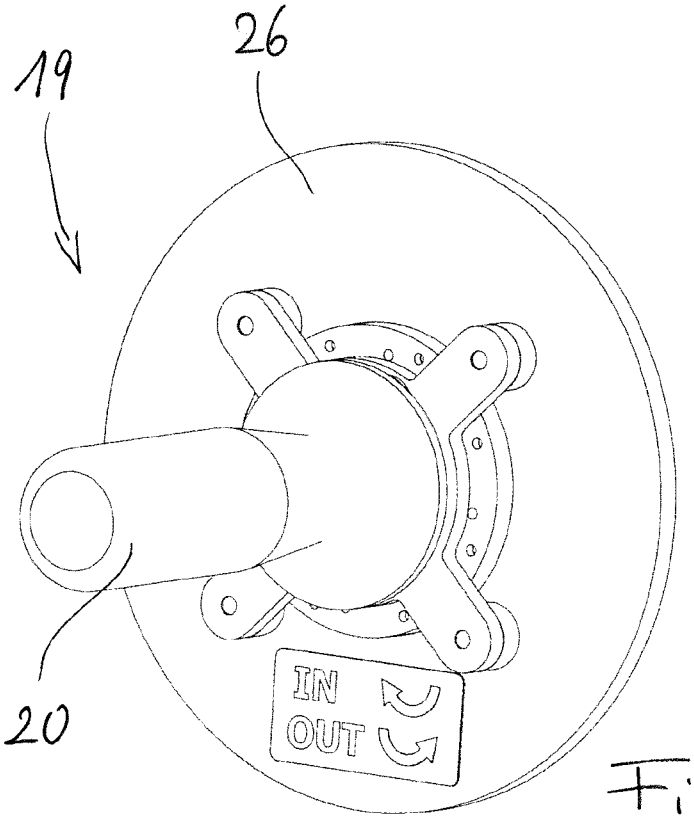
FIG. 4 shows the quick-change jig according to FIG. 3 from another perspective.
Figure 5:
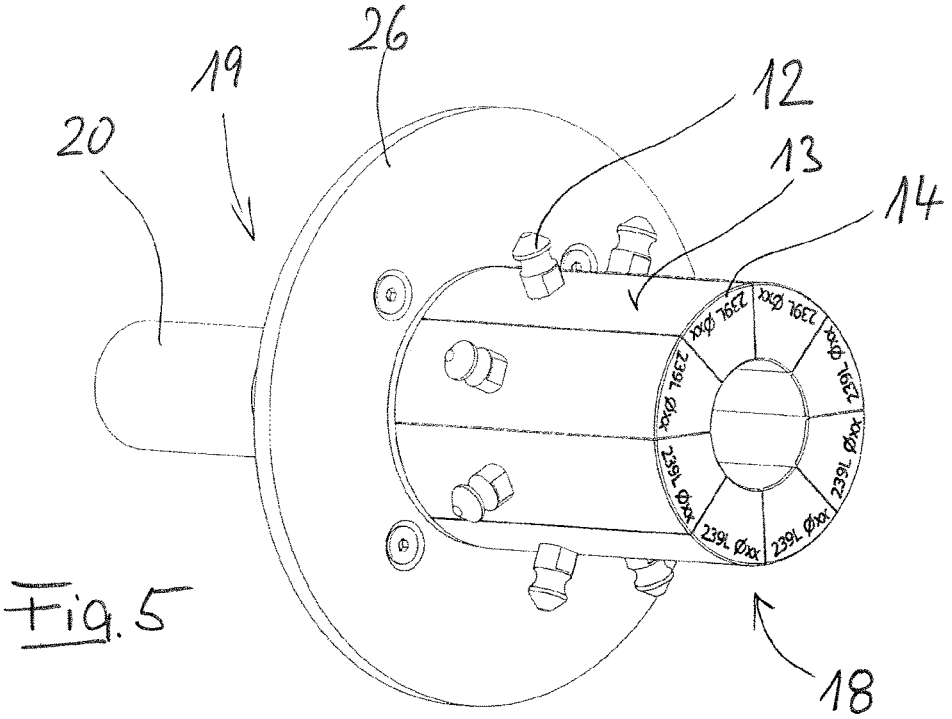
FIG. 5 shows the quick-change jig according to FIGS. 3 and 4 with a press-jaw set received thereon.

The eight press jaws 14, which may be constructed in a manner matching the sufficiently well known prior art, can be attached simultaneously to the eight base jaws 1 as a complete press-jaw set 18. For this purpose, they are received, as illustrated in FIG. 5, on the quick-change jig 19 shown in FIGS. 3 and 4. This comprises a handle 20 and a press-jaw holder 21 connected therewith in a manner to be turned together therewith. The latter is provided with eight pins 22, which engage in corresponding bores of the press jaws 14, as well as with holding magnets 23 disposed adjacent to this.

The insertion of the press-jaw set 18 into the installation space formed between the eight base jaws 1 takes place in that—during a first axial movement stage—the peg-like fixation projections 12 are respectively guided by being pushed into an open space 24 existing between two base jaws 1 adjacent to one another and, in fact, so far that they are respectively disposed opposite an opening 25 of the recesses 17 provided on the base jaws 1. This said position of the unit comprising quick-change jig 19 and press jaws 14 received on it is defined by a disk 26 which, forming a part of the quick-change jig 19, functions as a depth stop 27 by bearing on the front side of the base jaws 1. By turning the quick-change jig 19 by means of its handle 20 around its axis by 22.5°, the fixation projections 12 are respectively moved—along the associated recess 17—into their position aligned with the associated seat 11. This turning movement is limited by the cooperation of the fixation projections 12 and the seats 11 themselves. By bringing the base jaws 1 together radially in a manner corresponding to closing of the press tool, the fixation projections 12 completely enter the seats 11 and reach the mating faces 13 of the press jaws 14 in order to bear on the press-jaw bracing faces 6 of the base jaws 1. The locking devices 15 snap into place and respectively one base jaw 1 and one press jaw 14 mounted on it together respectively form a press member.

Figure 7:
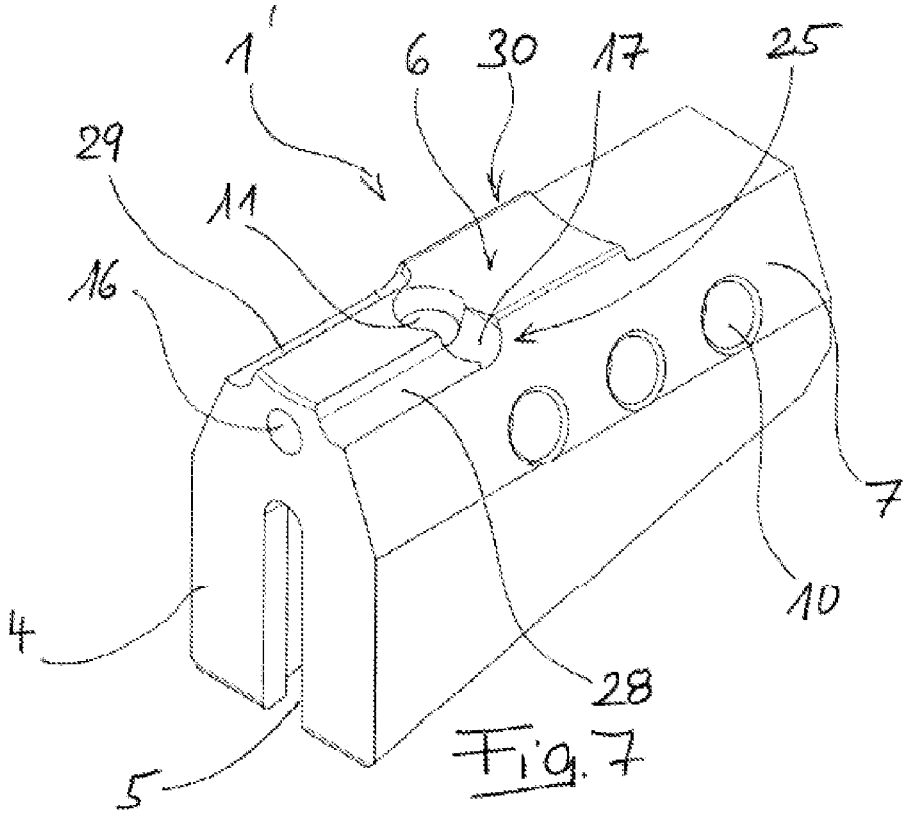
FIG. 7 shows a base jaw used in an inventive radial press modified, compared with FIGS. 1 and 2, according to a second exemplary embodiment, in a first perspective view.
Figure 8:
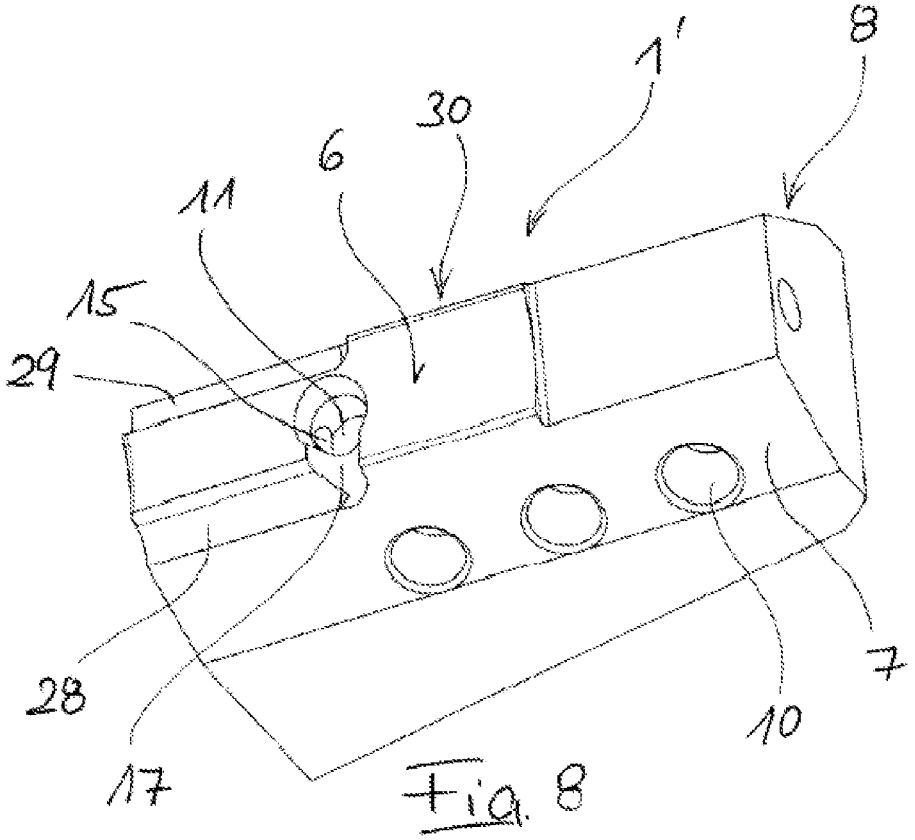
FIG. 8 shows the base jaw according to FIG. 7 from another perspective.

The base jaw 1' illustrated in FIGS. 7 and 8 represents a modification of the base jaw 1 according to FIGS. 1 and 2.

Substantially the foregoing explanations are correspondingly applicable to them. Decisive differences are two cutouts 28, 29 explained in more detail hereinafter. And, in fact, base jaw 1' is provided on that first side face 7 at which recess 17 opens, in the transition region from the press-jaw bracing face 6 to level with the first side face 7, with a cutout 28 extending from the opening 25 of the recess 17 to the first front side 16 of the base jaw 1'. On the opposite, second peripheral region 30 of the press-jaw bracing face 6, a further, second cutout 29 is provided, which—in approximately mirror-image manner relative to the first cutout 28—extends over a length comparable to that, likewise in axial direction as far as the first front side 16 of the base jaw 1'.

The two cutouts 28, 29, disposed opposite one another, of two base jaws 1' adjacent to one another define a kind of guideway for a press-jaw fixation projection 12 and, in fact with a width that is widened compared with the other free space 24 between the base jaws 1' in question.

Figure 9:
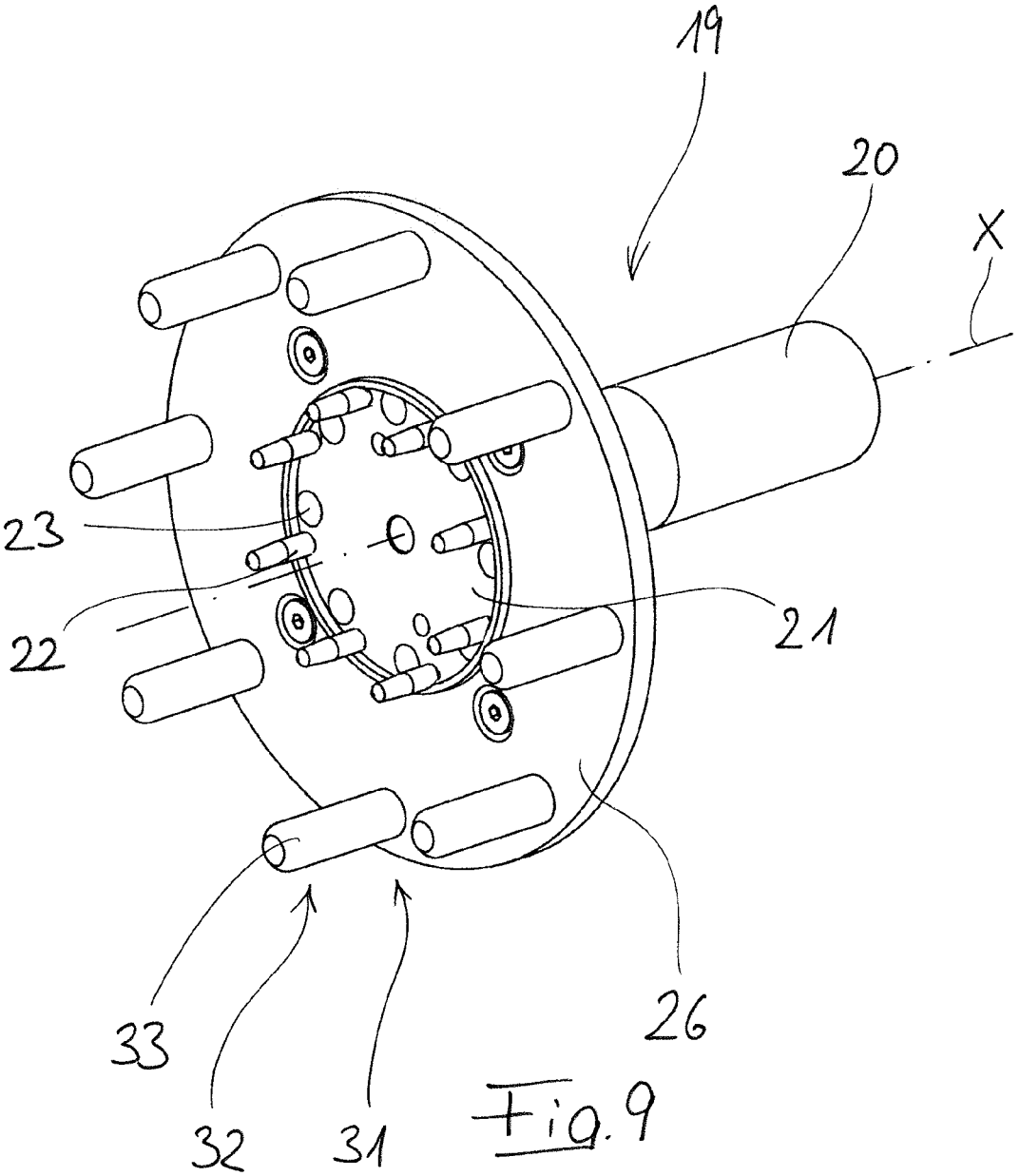
FIG. 9 shows a modification of the quick-change jig shown in FIGS. 3 and 4.

FIG. 9 illustrates the preferred assembly of the quick-change jig 19 (see FIGS. 3 to 5) with an unlocking arrangement 31. This comprises eight unlocking elements 32 in the form of unlocking pins 33, which are attached to the disk 26 forming the depth stop 27. During the axial positioning of the quick-change jig 19, the unlocking pins 33 enter the bores 16 of the base jaws 1 or 1' and unlock the locking devices 15. During the subsequent turning movement of the unit comprising handle 20 and press-jaw holder 21 (together with press-jaw set 18 received thereon), the disk 26 remains fixed in place. For this purpose, the press-jaw holder 21 and the disk 26 can be turned relative to one another (around the tool axis X).

What is claimed is:

1. A radial press (2), comprising a plurality of press members disposed around a press axis and capable of moving radially relative to the press axis, the radial press configured for moving the press members in the direction of the press axis or away from the press axis, wherein:

the press members each have a radial direction and a circumferential direction defined relative to the press axis and each comprise a base jaw (1; 1') of a plurality of base jaws and a press jaw (14) of a plurality of press jaws fixed exchangeably on the corresponding base jaw;

each base jaw (1; 1') of the plurality of press jaws comprises a radially inwardly disposed press-jaw bracing face (6) and two side faces (7, 8) adjacent the press-jaw bracing face of the corresponding base jaw in the circumferential direction;

each press jaw (14) of the plurality of press jaws comprises a mating face (13) for bearing on the press-jaw bracing face (6) of the corresponding base jaw (1; 1') and each press jaw has, protruding from the mating face (13), a fixation projection (12), which is inserted in a seat (11) provided on the base jaw (1; 1') and the fixation projection cooperates with a locking device (15) disposed in the seat of the base jaw;

wherein each of the base jaws (1; 1') of the plurality of base jaws is provided with an open channel recess at the press-jaw bracing face (6), wherein the open channel recess (17), connects and extends from the seat (11) to a first side face of the two side faces (7, 8) and opens at the first side face.

2. The radial press of claim 1, wherein the recess (17) extends in the circumferential direction.

3. The radial press of claim 1, wherein the press-jaw bracing faces (6) and the mating faces (13) are respectively constructed according to a circular-cylinder portion.

4. The radial press of claim 1, wherein each base jaw (1') is provided with a first cutout (28) extending from an opening (25) of the open channel recess (17) to a front side (4) of the base jaw (1').

5. The radial press of claim 4, wherein at a second side face of the two side faces opposite the first side face, adjacent a peripheral region (30) of the press-jaw bracing face (6), a second cutout (29) is provided, and the second cutout extends in an axial direction to the front side (4) of the base jaw (1').

6. The radial press of claim 1, wherein each base jaw (1') is provided at a second side face (8) of the two side faces disposed opposite an opening (25) of the recess (17), with a cutout (29) extending from a front side (4) of the base jaw to the opening (25) of the recess (17) of an adjacent base jaw (1').

7. The radial press of claim 1, wherein the locking device (15) exerts a radially outwardly directed preload force on the fixation projection (12) inserted in the seat on the corresponding base jaw.

8. The radial press of claim 1, wherein each base jaw is provided with a bore at a front side of the base jaw such that the corresponding locking device (15) is unlocked through the bore (16).

9. A radial-press system, comprising the radial press (2) of claim 8, and a quick-change jig (19) permitting changing of the press jaws all together and having a handle (20), a press-jaw holder (21) and an unlocking arrangement (31) having unlocking elements (32) capable of being inserted at the front side into the bores (16) of the base jaws (1; 1'), wherein the press-jaw holder (21) and the unlocking arrangement (31) of the quick-change jig (19) can be turned relative to one another around a tool axis (X).

10. The radial-press system of claim 9, wherein the press-jaw holder (21) of the quick-change jig (19) is connected to its handle (20) in a manner to be turned together therewith.

11. The radial-press system of claim 9, wherein the quick-change jig (19) is provided with a depth stop (27) cooperating with the front sides (4) of the base jaws (1; 1').

12. The radial-press system of claim 11, wherein the unlocking arrangement (31) is disposed on the depth stop (27).

* * * * *